United States Patent [19]

Puccerella

[11] Patent Number: 4,554,688

[45] Date of Patent: Nov. 26, 1985

[54] WATER SAVING SYSTEM

[76] Inventor: Thomas J. Puccerella, 111 Chippewa St., Miami Springs, Fla. 33166

[21] Appl. No.: 580,789

[22] Filed: Apr. 17, 1984

[51] Int. Cl.[4] ..... E03C 1/00

[52] U.S. Cl. ..... 4/191; 4/192; 4/559; 4/605; 4/661

[58] Field of Search ..... 4/192, 191, 598, 661, 4/605, 559

[56] References Cited

U.S. PATENT DOCUMENTS

| | | | |
|---|---|---|---|
| 3,450,159 | 6/1969 | Wilkin | 4/192 |
| 3,651,523 | 3/1972 | Miyahara et al. | 4/192 |
| 3,741,195 | 6/1973 | Ellis | 4/192 X |
| 4,370,543 | 1/1983 | Nemeth | 4/598 |
| 4,409,694 | 10/1983 | Barrett, Sr. et al. | 4/598 |

*Primary Examiner*—Henry K. Artis

[57] ABSTRACT

A water saving system for preventing the waste of water which falls below a predetermined temperature, which system includes a recirculating pipe line extending from an outlet faucet back to a heating device and which system is appropriately controlled thermostatically by a series of temperature sensing devices. The system includes a solenoid control valve which prohibits the delivery of water, which is below a predetermined temperature but which is appropriately controlled to be opened when the water in the delivery line is sufficiently heated. The system further includes a pump, which is energized to recirculate cooled water back to a heating source and which pump is de-energized when the water in the delivery line is at the desired predetermined delivery temperature.

4 Claims, 1 Drawing Figure

WATER SAVING SYSTEM

BACKGROUND OF THE INVENTION

The present invention is directed to apparatus for preventing the waste of water which typically occurs in households and industrial installations, when tap water is ordinarily permitted to go down the waste line until the tap water reaches the desired temperature, either hot or cold. While many devices and temperature controlling systems have been employed, including those which provide "instant hot water" at a faucet, none is believed to operate in the unique, water-saving manner of the present invention.

SUMMARY OF THE PRESENT INVENTION

The present invention fundamentally includes a water treatment (heater or cooler) apparatus, a delivery pipe of substantial length extending from the outlet of the hot water heater (or cooler) to a faucet from which the heated/cooled water may be withdrawn upon opening of the same. In accordance with the principles of the present invention, a waste-preventing, feedback loop is established by the installation of a recirculating pipe line which extends from slightly upstream of the delivery faucet back to the water treatment unit, which recirculation line has associated therewith interconnected control apparatus in the nature of solenoid valves, check valves, a pump and associated thermostatic controls for the purpose of emptying the delivery line of water, which is not at the desired delivery temperature when the faucet is opened and saving the drained water. In this manner there is no need to waste water by draining into the waste line the delivery line of all water which is not at the predetermined delivery temperature, as established by thermostatic controls at the hot water heater and as detected by an appropriate temperature device immediately adjacent the faucet.

For a better appreciation of the operation of the present invention, as well as a greater understanding of the advantages to be derived from the practice of the present invention, reference should be made to the accompanying drawing taken in conjunction with the following detailed description of the invention.

DETAILED DESCRIPTION OF THE INVENTION

Figure 1:
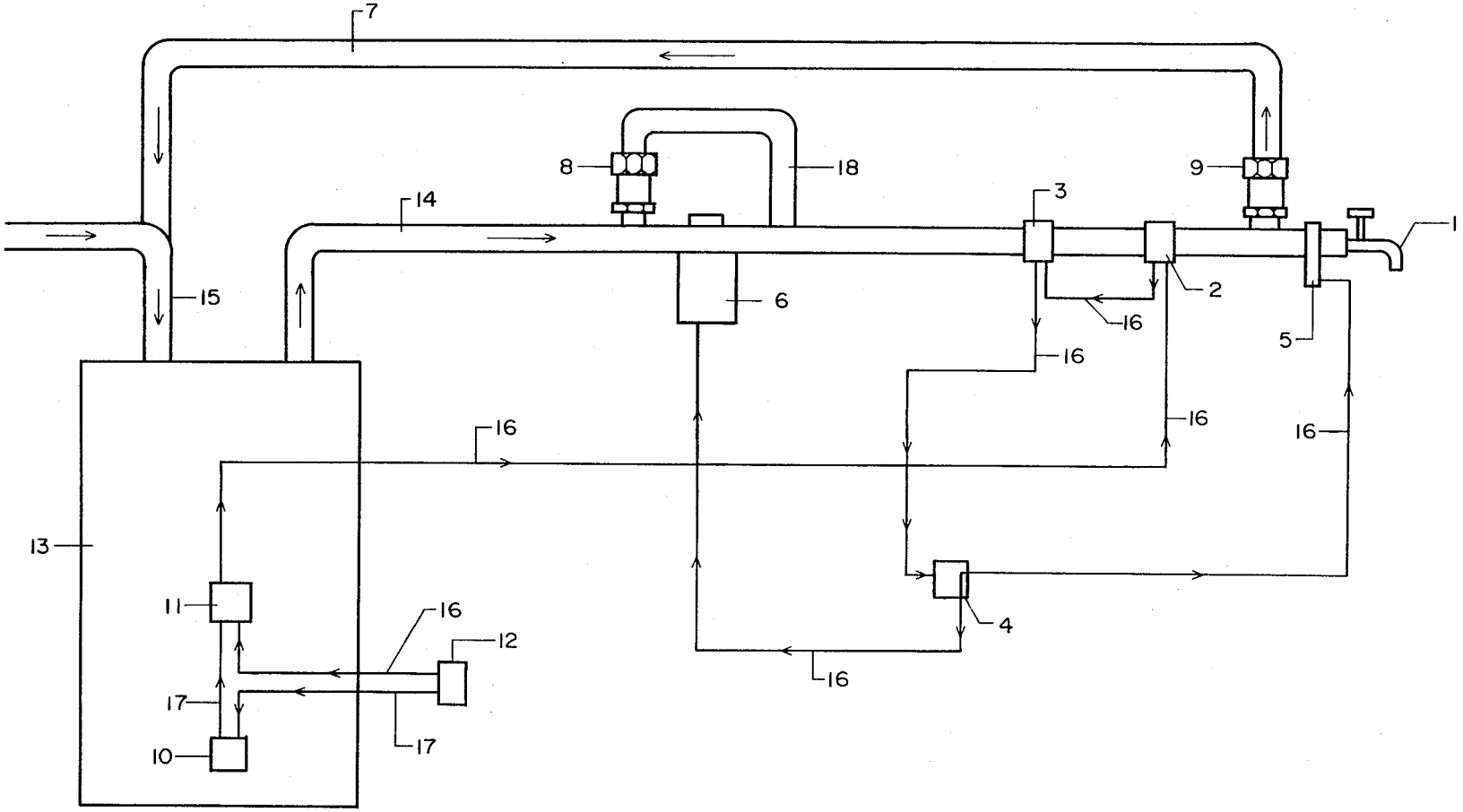
FIG. 1 is a schematic representation of a water saving system embodying the principals of the present invention.

The present invention typically includes a hot water heater 13, which may be of any conventional construction, including heating elements 10 and 11 which are controlled by a thermostat 12, which may be adjusted to set the desired outlet temperature of the hot water heater, e.g. 115° F.

While the invention is described with reference to a hot water heater, it will be understood that other water treatment devices such as a water cooler may be employed in lieu of the heater and rather than setting the thermostat 12 for a highly elevated temperature, the thermostat of a comparative cooling device will be set at a substantially reduced temperature. As will be understood, a water inlet pipe 15 supplies the hot water heating unit 13, which water is then heated up to the preset temperature by the heating units 10 and 11. The hot water is then delivered to a faucet a substantial distance from the hot water heater through a delivery pipe line 14, which terminates at a manually operable faucet 1.

As contrasted with a conventional hot water delivery system, the opening of the faucet 1 will not permit flow of water from delivery pipe 14 unless the temperature in the water immediately upstream of the faucet 1 is at the desired preset temperature of a thermostat 12 in sensor 2 in the line 14. This is effected by interposing a solenoid valve 5 immediately upstream of the faucet 1, which solenoid valve remains closed through the control of sensor 2, flow detector 3, and relay 4 if the water temperature in the pipe 14 is not at a predetermined temperature. In that event, water is returned through a recirculating pipe 17, which includes a oneway check valve 9, back into the water heater 13 to be appropriately heated and the water (which has not been delivered to the faucet and has been recirculated back to the heater) is replaced in the delivery pipe 14 by appropriately freshly heated water of the requisite temperature. When that heated water is sensed by the sensor 2, to be of the requisite elevated temperature, relay 4 opens valve 5 permitting the delivery of heated water to the faucet and prohibiting the waste any water from the delivery pipe 14, which is not sufficiently heated in accordance with the invention. The control elements for regulated flow in the new water water saving system of the invention include a pump 6, which is interposed in the delivery line 14, as well as flow for sensing metering device 3 and sensor 2, which are all appropriately associated with one another, the pump and hot water heater by appropriate electrical lines 16,17. In addition, in order to permit the free flow of water through the line 14 when recirculation pump 6 is not in operation, a bypass line 18 shunts the pump as shown. An appropriate check valve 8 is included on the upstream side of the bypass line 18.

As will be understood, the water saving system of the present invention functions to eliminate any waste of water, which is not at the preset temperature in the delivery line. Such waste occurs when the water has been at rest for a substantial period of time in the pipe 14 and has lost heat to the ambient atmosphere by convection and radiation. Specifically, when the faucet 1 is opened, the water will flow directly from the hot water heater therethrough if the temperature is sensed by the temperature sensing device 2 to be at an adequate predetermined temperature; if not, the solenoid valve 5 will not open, the pump 6 will be started and will force water through the check valve 9 thereby evacuating delivery line 14 of the cool water and delivering it back through the recirculation line 7 and into the water heater through the inlet line 15. When the temperature sensing device 2 detects that the water being delivered through the delivery line 14 has reached the predetermined elevated temperature, pump 6 will be de-energized and the solenoid valve 5 will be opened to permit the flow of hot water out of the faucet. If the pump 6 is of the type, which when deenergized does not permit flow therethrough, the flow of the hot water will be through the bypass line 18 as will be readily understood.

The apparatus of the present invention, has been described with reference to the accompanying schematic drawing with the control elements illustrated somewhat spaced apart for the sake of clarity, however, it is to be understood that the control elements may be miniaturized and/or otherwise consolidated, compacted, and housed in a small, space-saving unit, which itself may be disposed conveniently in the system and adjacent to the outlet faucet 1 as desired or found necessary. Since various other modifications and alterations of the control circuit elements will be apparent to those skilled in the art, reference should be made to the following appended claims to determine the full scope of the present invention.

I claim:

1. A water saving system comprising (a) a water treatment apparatus;

(b) a delivery line extending from said water treatment apparatus to an outlet faucet;

(c) a recirculating line extending upstream of said faucet from a point closely adjacent thereto back to said water treatment apparatus;

(d) a recirculating pump interposed in said delivery line;

(e) temperature sensing means in said delivery line immediately upstream of said faucet;

(f) control means for operating said pump when the temperature of the water in said delivery line immediately upstream of said faucet, as detected by said sensing means, is below a predetermined desired delivery temperature;

(g) a thermostatically controlled valve disposed in said delivery line immediately upstream of said faucet;

(h) said control means also being associed with said thermostatically controlled valve to open said valve only when the temperature in said delivery line immediately upstream of said faucet is at said predetermined temperature.

2. The water saving system of claim 1, which further includes (a) a pump bypass line associated with said pump and said delivery pipe line to accommodate the flow of water around said pump when said pump is de-energized.

3. The water saving system of claim 2, which further includes (a) a one-way check valve disposed in said recirculating pipeline and one way check valve also disposed in said pump bypass line.

4. The water saving system of claim 1 in which (a) said water treatment apparatus is a hot water heater.

* * * * *